US008028827B2

(12) United States Patent
Balix et al.

(10) Patent No.: US 8,028,827 B2
(45) Date of Patent: Oct. 4, 2011

(54) PACKAGING FOR OPTHALMIC LENS

(75) Inventors: Laurene Balix, Charenton le Pont (FR); Guy Schott, Charenton le Pont (FR)

(73) Assignee: Essilor International (compagnie Generale d'optique), Charenton le Pont (FR)

( * ) Notice: Subject to any disclaimer, the term of this patent is extended or adjusted under 35 U.S.C. 154(b) by 24 days.

(21) Appl. No.: 12/526,791

(22) PCT Filed: Feb. 19, 2008

(86) PCT No.: PCT/FR2008/050272

§ 371 (c)(1),
(2), (4) Date: Aug. 12, 2009

(87) PCT Pub. No.: WO2008/113930

PCT Pub. Date: Sep. 25, 2008

(65) Prior Publication Data

US 2010/0038264 A1 Feb. 18, 2010

(30) Foreign Application Priority Data

Feb. 22, 2007 (FR) ..... 07 01268

(51) Int. Cl.
*A45C 11/04* (2006.01)

(52) U.S. Cl. ..... 206/5.1; 134/901

(58) Field of Classification Search ..... 206/5.1, 206/205; D24/218; 134/137, 901; 422/300, 422/301

See application file for complete search history.

(56) References Cited

U.S. PATENT DOCUMENTS

| | | | | |
|---|---|---|---|---|
| 3,977,517 | A * | 8/1976 | Kadlecik et al. | 206/5.1 |
| 3,990,579 | A * | 11/1976 | Manning | 206/5.1 |
| 4,392,569 | A * | 7/1983 | Shoup | 206/5.1 |
| 5,738,219 | A | 4/1998 | Arsena et al. | |
| 2005/0133382 | A1 * | 6/2005 | Gerard et al. | 206/5.1 |
| 2008/0271844 | A1 | 11/2008 | Lacan et al. | |

FOREIGN PATENT DOCUMENTS

| | | |
|---|---|---|
| FR | 2801574 | 6/2001 |
| JP | 2000000111 | 6/1998 |
| JP | 11011562 | 1/1999 |
| JP | 2006321497 | 11/2006 |
| NL | 8700276 | 9/1988 |

* cited by examiner

*Primary Examiner* — Luan K Bui

(74) *Attorney, Agent, or Firm* — Occhiuti Rohlicek & Tsao LLP

(57) ABSTRACT

The invention relates to a packaging for an ophthalmic lens (100) that comprises a box (200) and a lens holder (300) inside the closed box. The holder includes at least one flexible portion (305) that is bent by the lid (202) of the box when said lid is closed. The portion thus bent bears against a peripheral edge (B) of the lens in order to maintain said lens at a distance from the lid inside the box. A convex face (S1) of the lens in the box is thus protected against any damage.

18 Claims, 4 Drawing Sheets

PACKAGING FOR OPTHALMIC LENS

CROSS-REFERENCE TO RELATED APPLICATIONS

Figure 1A:
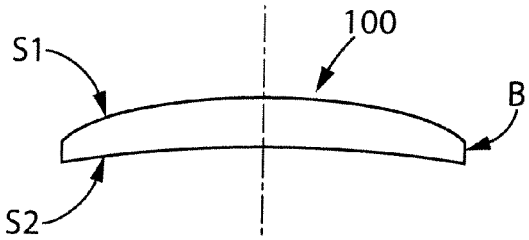

This application is the National Stage of International Application No. PCT/FR2008/050272, filed on Feb. 19, 2008, which claims the priority of French Application No. 0701268, filed on Feb. 22, 2007. The contents of both applications are hereby incorporated by reference in their entirety.

The present invention relates to a packaging that is designed to contain an ophthalmic lens.

An eyeglass of ophthalmic spectacles is obtained from an ophthalmic lens by carrying out a trimming or edging of the latter. Trimming consists in machining the lens on its peripheral edge in order to bring the latter to the dimensions of a housing of a frame of a pair of spectacles in which the lens is intended to be assembled.

The ophthalmic lens, prior to the trimming operation has standard dimensions parallel to the optical faces of the latter. Usually the ophthalmic lens has a peripheral edge which is circular, with a diameter equal to approximately 70 mm.

It is often necessary to store or transport the ophthalmic lens before trimming, for example between a factory for manufacturing the lens and a laboratory where the trimming is carried out. The optical faces of the lens must then be protected from any damage which could occur during such storage or transport. Specifically there is a risk that one of the faces of the lens is lined, scratched or marked. This risk is particularly high for the convex face of the ophthalmic lens because of its prominence relative to the peripheral edge of the lens.

Another risk relates to a friction layer which is sometimes formed on at least one of the faces of the lens. Such a friction layer is used in particular when this face is covered with a dirt-resistant coating. It improves the holding of the lens in the trimming tool. Specifically, the lens is held between two holding parts of the trimming tool which are pressed against the two opposite faces of the lens. Under the effect of the machining stress which is applied during the trimming, the lens may slip between the two holding parts. A trimming contour is then obtained which no longer corresponds to the housing of the frame of pairs of spectacles. The friction layer prevents the lens from slipping in the trimming tool in this way. For this purpose, it must not itself be damaged.

To prevent such damage to the convex face of the lens or to a friction layer which may be carried by the latter, a removable protection pad is sometimes stuck to a central portion of the convex face of the lens. Such a pad effectively protects the convex face of the lens against any other external contact and the lens thus protected can be placed in a flexible pouch, for example made of paper.

But when the lens comprises inscriptions on its convex face over the friction layer, the ink that is used for the inscriptions is removed at the same time as the pad. For this reason, protection by a removable pad is not compatible with all the ophthalmic lenses that must be stored or transported.

A proposal has also been made to place each ophthalmic lens individually in a protective box, for example made of cardboard. But it is then necessary to hold the lens in a fixed position inside the box in order to prevent friction of the convex face of the lens against the box, inside the latter, from creating lines on this face or damaging a friction layer carried by the latter. For this purpose, document JP 11-011562 proposes to stick a strip onto the peripheral edge of the lens. This strip extends beyond each face of the lens and has a width that is equal to the internal height of the box. But such a packaging is difficult to apply, notably because of the sticking of the strip around the lens.

One object of the invention is therefore to provide a packaging which protects efficiently an ophthalmic lens, in particular the convex face of the latter, and which is compatible with the possible presence of a friction layer and of an ink marking on this face.

For this purpose, the present invention proposes a packaging which is suitable for containing an ophthalmic lens having a predetermined peripheral edge and which comprises:

- a box which itself has a bottom, a lid for opening and closing that is substantially parallel to the bottom when the box is closed, and at least one sidewall element defining an internal height of the box comprised between the bottom and the lid; and
- a support which is suitable for supporting the lens by its peripheral edge.

Dimensions of the box and of the support are suitable for the box to be able to contain the support with the lens in a fixed position when the lid is closed. In this position, a convex face of the lens is turned toward the lid. In addition, in order to immobilize the support in the closed box, a height of the support contained in the closed box is equal to the internal height of the box.

According to one feature of the invention, the support comprises at least one flexible portion which is situated close to the peripheral edge of the lens carried by the support. This flexible portion extends in the direction of the lid when the closed box contains the support with the lens, with a length of the flexible portion that is suitable for the closed lid to bend it by pressure. The curved flexible portion then presses against the peripheral edge of the lens so as to hold the latter apart from the lid inside the box.

Therefore, a packaging according to the invention comprises two portions, the box and the lens support, which interact to determine the position of the lens in the box when the latter is closed. For this purpose, the flexible portion of the support is deformed by the lid in the closed configuration of the box, by being bent, and this deformation in turn causes an appropriate holding of the lens inside the box. The lens is therefore held by its peripheral edge at a distance from the closed lid. When the lens is placed on the support in the closed box with its convex face turned toward the lid, all contact with this face is avoided. In this manner, the lens is protected efficiently.

Such a protection is efficient for the lens itself, and for a friction layer which may be carried by the face of the lens which is turned toward the lid in the closed box. It is also compatible with the presence of an ink marking on such a friction layer: the friction layer and the marking are intact after the box is opened to retrieve the ophthalmic lens.

A first advantage of a packaging according to the invention arises from the fact that the flexible portion which wedges the lens in the box is actuated by the lid, when the latter is closed. A handling gain is thus obtained during the packaging of the lens in the box.

A second advantage results from the use of a flexible or resilient portion. When the box is opened again, the portion at least partially reverts to its initial shape, so that the wedging of the lens inside the box is relaxed. The lens is therefore released at least partly and can be easily removed from the support. Moreover, the packaging can be reused for a new lens package.

A third advantage arises from the fact that no packaging portion is fitted or attached to the lens. The packaging of the lens for its storage or its transport is then particularly quick to carry out.

In various embodiments of the invention, the user may optionally also implement one and/or other of the following improvements:

- the support may comprise at least two flexible portions which are suitable for each to press against the peripheral edge of the lens, in two locations spaced from one another along this edge, while each being bent by the lid when the closed box contains the support with the lens;
- the lid may have, inside the closed box, a recess which is situated facing a central portion of the lens, so as to locally increase a distance between the lens and the lid;
- the support may laterally hold tightly a portion of the peripheral edge of the lens, and may deform elastically in order to release the lens;
- the support may comprise two arms which are suitable for extending on two opposite sides of the peripheral edge of the lens. It may then be suitable for releasing the lens when these two arms are opened;
- the support may also comprise:
  - rigid spacer portions which are suitable for maintaining, when the closed box contains the support, a distance between the bottom and the lid which is at least equal to the internal height of the box, independently of the flexible finger; and
  - at least one rim segment which is oriented in the direction of the lid when the closed box contains the support with the lens, the rim segment being suitable for maintaining a fixed distance between the lens and the bottom of the box;
  - at least one side bearing portion, which is placed on a side of the support that is substantially opposite to the flexible portion, and which is adapted so that, when the closed box contains the support with the lens, the peripheral edge of the lens is immobilized laterally between this bearing portion and the bent flexible portion; and
- the flexible portion of the support may comprise a recess which is situated on a side of this portion that is opposite to the lid when the closed box contains the support with the lens. Such a recess has an abutment surface which is oriented toward the bottom of the box, and is adapted to receive an angle of the lens which is situated between the peripheral edge and a face of the lens oriented toward the lid, so as to keep the lens at a distance from the lid in an additional manner relative to the bending of the flexible portion.

The invention also proposes to use a packaging as described above with an ophthalmic lens so that the face of the lens which is oriented toward the lid is separated from the latter by a distance of more than 2 mm, in a central portion of this face, when the closed box contains the support with the lens.

Figure 1B:
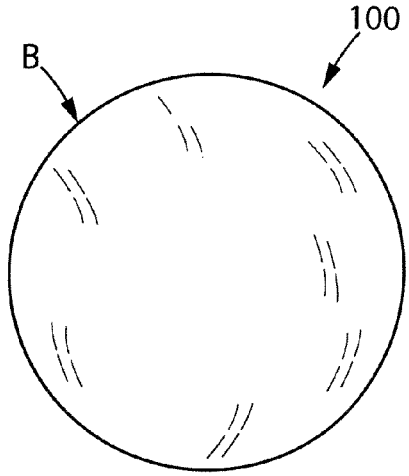
Figure 2A:
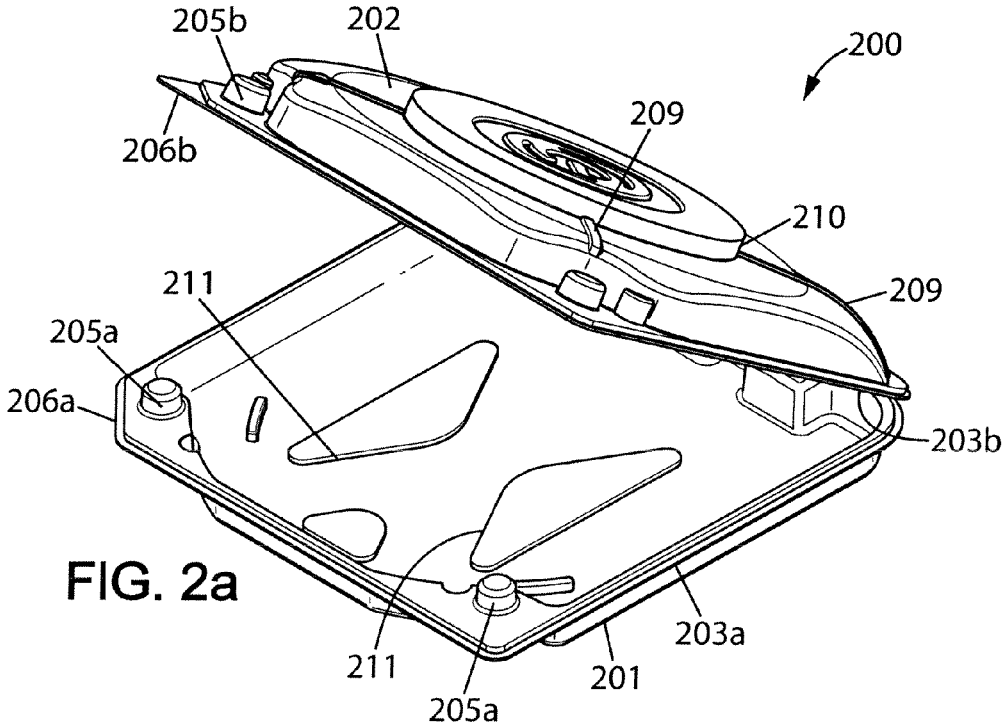
Figure 2B:
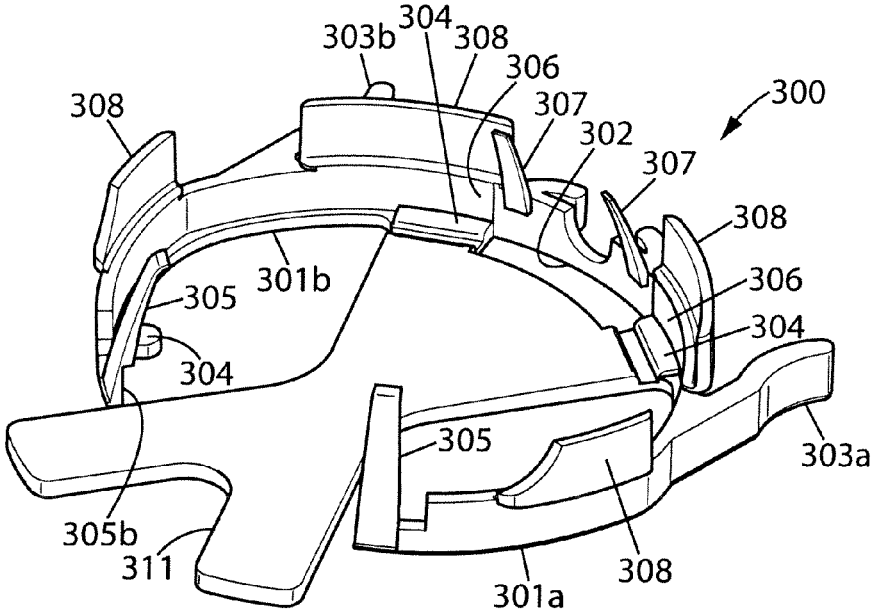
Figure 3A:
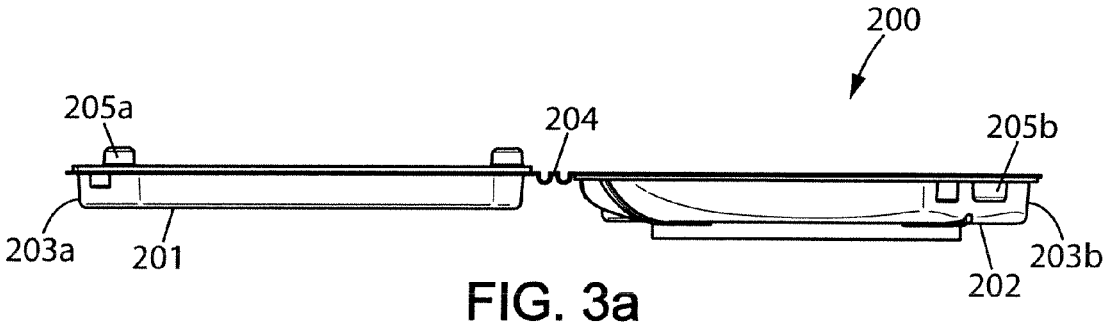
Figure 3B:
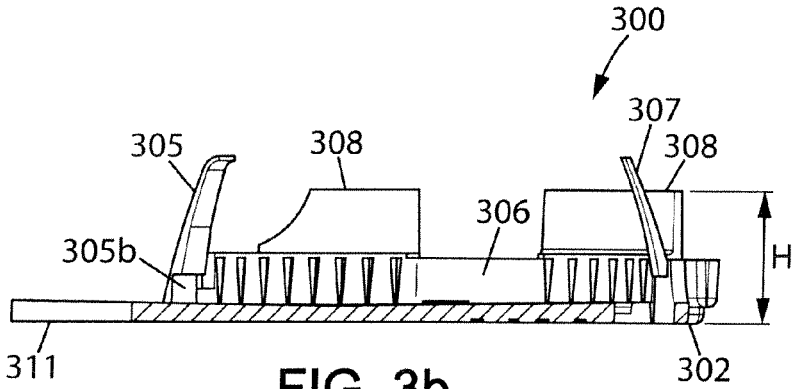

Other particular features and advantages of the present invention will appear in the following description of a non-limiting exemplary embodiment, with reference to the appended drawings in which:

FIGS. 1*a* and 1*b* are views of an ophthalmic lens for which a packaging according to the invention is intended, respectively in section and in plan view;

FIGS. 2*a* and 2*b* are perspective views respectively of a box and of a support forming a packaging according to the present invention;

FIGS. 3*a* and 3*b* are side and sectional views respectively of a box and of a support in accordance with FIGS. 2*a* and 2*b;*

Figure 4A:
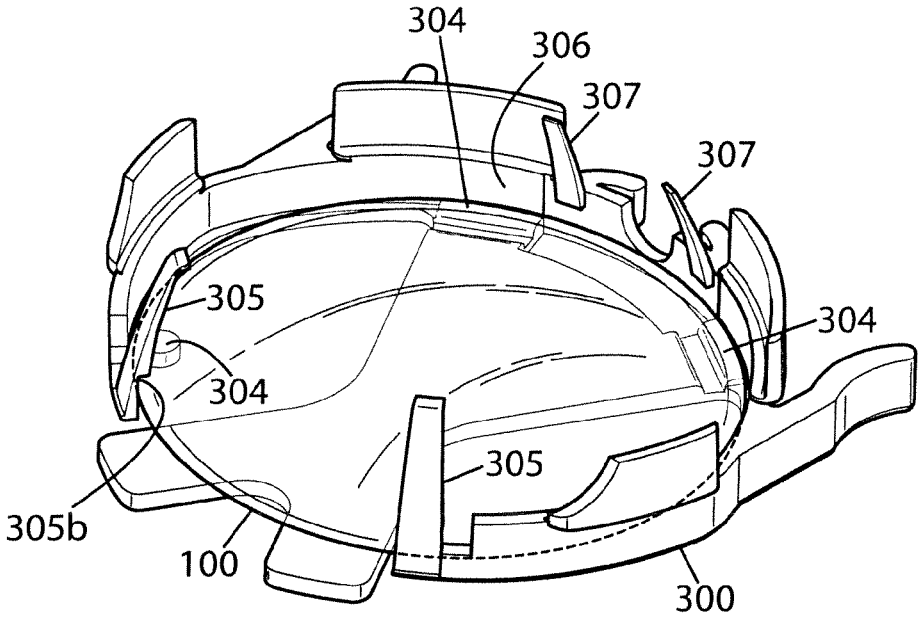
Figure 4B:
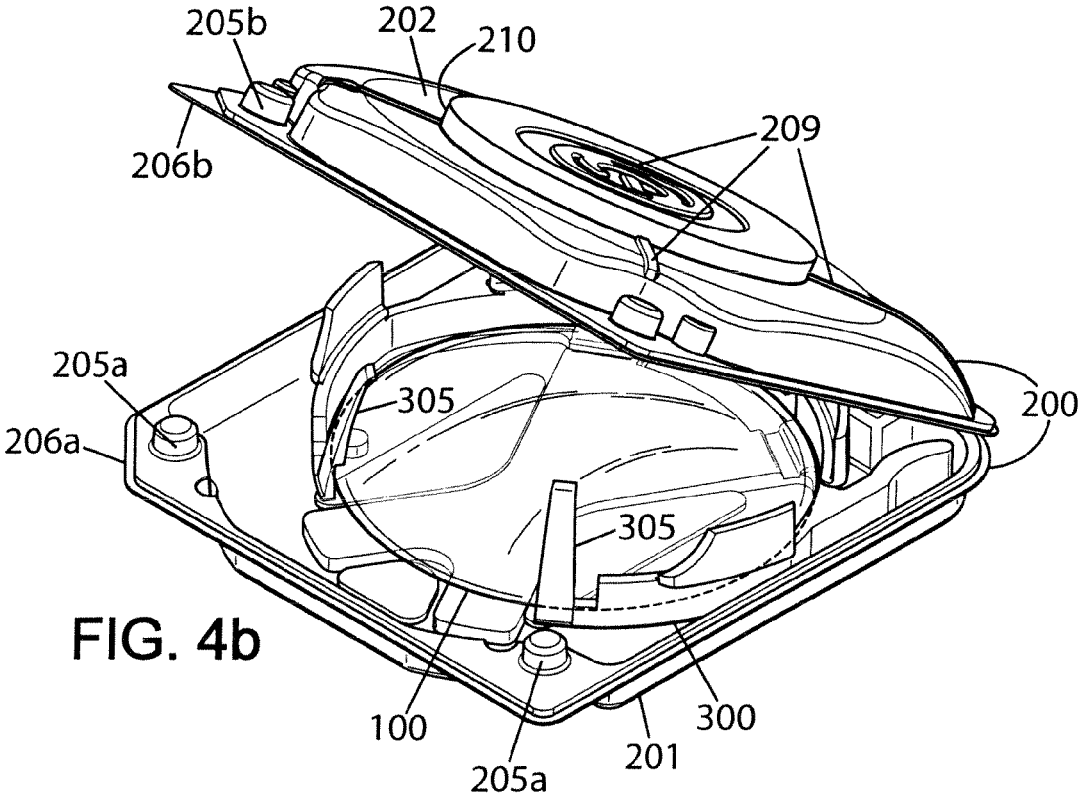
Figure 4C:
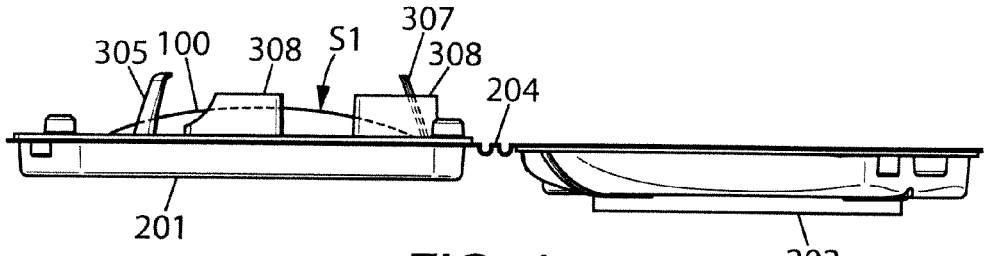
Figure 4D:
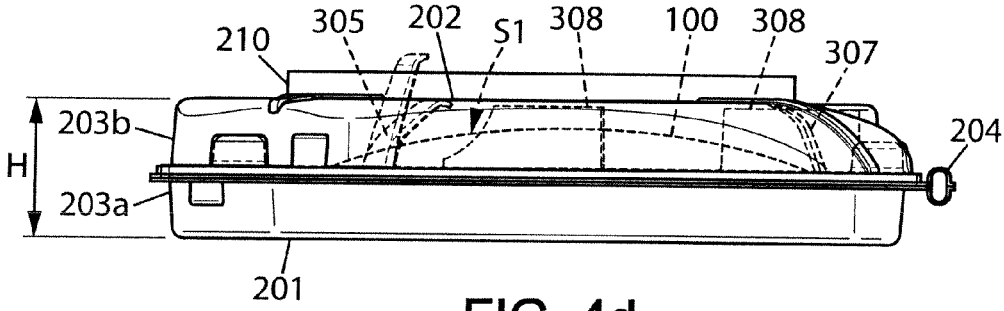
Figure 5A:
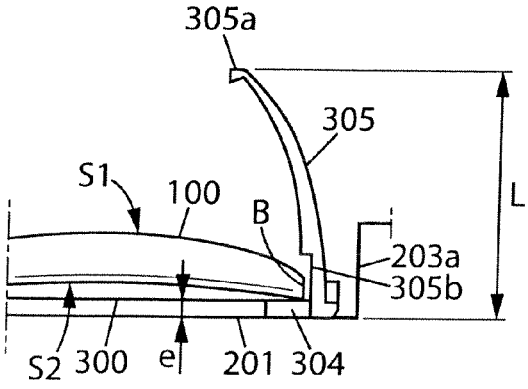
Figure 5B:
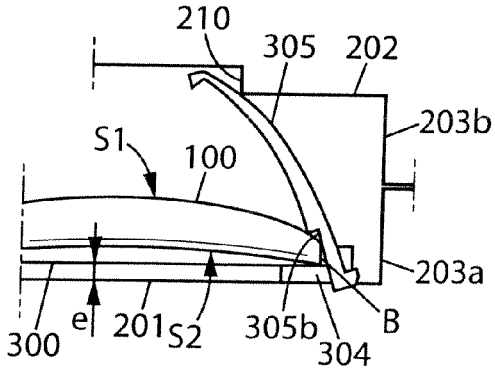

FIGS. 4*a*-4*d* illustrate the use of a packaging in accordance with FIGS. 2*a* and 2*b*, with perspective views for FIGS. 4*a* and 4*b* and two side views for FIGS. 4*c* and 4*d;* and FIGS. 5*a* and 5*b* are enlargements showing the principle of operation of a flexible portion of the support.

It is understood that the dimensions of the various packaging portions which are represented in these figures do not necessarily correspond to actual dimensions or to actual dimension ratios. In addition, identical reference numbers in different figures correspond to identical elements.

With reference to FIGS. 1*a* and 1*b*, an ophthalmic lens 100, for which a packaging according to the invention is intended, has a circular peripheral edge denoted B. The diameter of the lens 100 is fixed. Preferably, it is common to a large number of lenses. The packaging which is described in the rest of the description is intended for the lens 100 before the latter is trimmed, so that the shape and the diameter of the peripheral edge B are predetermined. Usually, this diameter is equal to approximately 70 mm.

The ophthalmic lens 100 has a convex face and a concave face, respectively denoted S1 and S2. The face S1 has a shape which is usually definitive, and may bear functional coatings such as an antireflective coating, a hard coating, a dirt-resistant coating, etc., or a combination of some of these coatings. It may also bear a friction layer and/or ink inscriptions. The concave face S2 may be definitive or intended to be reworked with machining, depending on whether the lens 100 is a lens blank or a lens already machined according to an ametropia correction prescription which is determined for a wearer for whom the lens is intended. The lens 100 may be made of any material that is used in the ophthalmic field, and the packaging described below is suitable whatever this material may be.

The packaging comprises a box with the overall reference number 200 (FIGS. 2*a* and 3*a*) and a lens support with the overall reference number 300 (FIGS. 2*b* and 3*b*).

The support 300 may be made of an injected material, such as polypropylene, and the box 200 may be formed from a sheet of thermoformable material, such as polystyrene. In this manner, the complete packaging may have a very low cost price. If necessary, various elements may be fitted to the thermoformed sheet of the box 200, but it is particularly economical that such elements are made in a form integrated into the sheet during thermoforming.

The box 200 comprises a bottom 201, a lid 202 and two sidewall elements 203*a* and 203*b*. The lid 202 is connected to the bottom 201 by a hinge 204. The wall elements 203*a* and 203*b* are respectively supported by the bottom 201 and the lid 202, and together form the sidewall of the box when the lid 202 is rotated about the hinge 204 so as to come parallel to and facing the bottom 201. This position of the lid 202 corresponds to the closed configuration of the box 200. The sidewall elements 203*a* and 203*b*, which are then in abutment against one another, fix an internal height of the closed box, denoted H (FIG. 4*d*). This height H corresponds to the distance separating the bottom 201 and the lid 202 for the closed configuration. Preferably, the wall elements 203*a* and 203*b* completely close off the internal volume of the box 200, in order to isolate it from possible splashes of particles which might occur on the outside.

The box 200 is opened by rotating the lid 202 about the hinge 204, moving the lid away from the bottom 201.

The box 200 may comprise fastening elements 205*a* and 205*b* which are respectively connected to the bottom 201 and to the lid 202 and which are suitable for keeping the box closed. For example, the fastening elements 205*a* and 205*b* are suitable in pairs for fitting into one another with immobilization when the box 200 is closed.

The box 200 may also comprise grasping portions 206*a* and 206*b* which are respectively connected to the bottom 201 and to the lid 202. These grasping portions are suitable for allowing an opening of the box 200 by parting of said grasping portions. If necessary, portions 206*a* and 206*b* that are situated facing one another when the box is closed have respective edges that are offset relative to one another. In this manner, the portions 206*a* and 206*b* are easier to grasp.

In the embodiment of the box 200 that is illustrated by FIGS. 2*a* and 3*a*, all the box elements that are cited above are formed in an integral manner in a thermoformed sheet, by appropriate offsets and cutouts of portions of this sheet. The hinge 204 is formed by a reversible bending of the sheet.

The support 300 is suitable for laterally holding tightly a portion of the peripheral edge B of the lens 100, and for deforming radially in order to release it. For this purpose, it comprises two arms 301*a*, 301*b* which are suitable for extending on two opposite sides of the edge B of the lens 100 when the latter is placed on the support 300 (FIG. 4*a*). The two arms 301*a* and 301*b* are connected by a central portion 302 of the support 300. The portion 302 can be deformed elastically in order to release the lens 100 by radially parting the two arms, like a pincer which grips the lens 100 by its edge B. For this reason, the support 300 may be called a "gripper". The two arms 301*a* and 301*b* may each be provided with a support-actuation portion. These actuation portions, reference numbers 303*a* and 303*b*, are suitable for causing the arms 301*a* and 301*b* to open when an external force is applied between them. In this manner, the support 300 is easily actuated to grip or release the lens 100. The actuation of the support 300 by the portions 303*a* and 303*b* may be manual or mechanical, by means of tool heads which are adapted to apply appropriate pressures to these portions.

The lens 100 is placed on the support 300 as shown in FIG. 4*a*, by actuating the support in the manner that has just been described. At this time, the convex face S1 of the lens 100 is turned upward and the concave face S2 is turned downward. Then the assembly of the support 300 and of the lens 100 thus placed on said support is put into the open box 200, as shown in FIG. 4*b*. The lid 202 can then be closed again. The convex face S1 of the lens 100 is then turned toward the lid 202 inside the box 200.

The internal height H of the closed box 200 is strictly greater than the total thickness between the bottom 201 of the box and the convex face S1 of the lens 100 in the configuration of FIG. 4*d*. In this manner, the convex face S1 of the lens is not in contact with the internal face of the closed lid 202. One and the same packagings may be suitable for lenses 100 which have variable total thicknesses so long as the lid 202 does not come into contact with the convex face of the lenses when it is reclosed. If necessary, several packaging may be provided, which have different internal heights H in order to cover a range of lenses intended to be packaged which have variable thickness values across a wide range. For example, H may be equal to 17.5 mm approximately for such a box 200.

According to a possible improvement, the support 300 and the bottom 201 of the box may respectively comprise portions with matching reliefs 311 (FIG. 2*b*) and 211 (FIG. 2*a*) which are situated facing one another when the support 300 is in the box 201. These portions with reliefs, which fit into one another when the support 300 is placed on the bottom 201, prevent a movement of the support 300 parallel to the bottom and to the lid of the box. Thanks to such portions with matching reliefs, the box 200 may be wider than the support 300, which makes it easier to insert the support into the box, and to do so without lateral movements of the support in the closed box being able to occur. In an equivalent manner, such portions with matching reliefs may be supported respectively by a top portion of the support 300 and by the lid 202, so as to fit into one another when the lid 202 is reclosed.

According to another improvement, the support 300 may comprise at least one rim segment 304 which is oriented in the direction of the lid 202 when the closed box contains the support with the lens. Such a rim segment 304 is suitable for maintaining a fixed distance between the lens 100 and the bottom 201 of the box. For example, the support 300 comprises four rim segments 304 which support the lens 100 via its concave face S2, close to the peripheral edge B. The rim segments are preferably situated at a distance from one another on the arms 301*a* and 301*b* so as to support the lens 100 in a stable manner. For example, the rim segments 304 have a common thickness e of 2 mm so as to set this distance between the edge B of the lens 100 and the bottom 201 (FIGS. 5*a* and 5*b*).

According to the invention, the support 300 comprises one or more flexible portions 305, which are bent by the lid 202 while pressing on the edge B of the lens 100. In the exemplary embodiment that is described, these portions 305 each have the shape of a finger that is substantially perpendicular to the support 300. For this reason, they are called flexible fingers 305 in the rest of the description. These flexible fingers 305 are two in number and are situated respectively close to the ends of the arms 301*a* and 301*b*. The fingers 305 are connected elastically to the arms 301*a* and 301*b*. They may be injected in a single piece with the arms 301*a*, 301*b* and the central portion 302 of the support 300.

The fingers 305 are directed toward the lid 202 and may initially be tilted or curved toward the center of the lens 100 when the lid 202 is not yet closed. They each have a length L such that their top free ends 305*a* extend beyond the opening of the box 200 when the latter is open, beyond the closed position of the lid 202. In this manner, the lid 202 presses on the ends 305*a* of the fingers 305 when it is reclosed, bending them further toward the center of the lens 100 (FIGS. 4*c*, 4*d*, 5*a* and 5*b*). If necessary, the arms 301*a* and 301*b* may also deform elastically, particularly by torsion, and thereby participate in a swiveling of the fingers 305 toward the center of the lens 100 when the lid 202 is reclosed. In a general manner, the bending of the fingers 305 toward the center of the lens results from a deformation of the fingers themselves and of the arms 301*a* and 301*b*.

During this bending of the fingers 305 which is caused by the lid 202, a main portion of each finger swivels simultaneously about the base of the fingers on the arms 301*a* and 301*b*, in the direction of the center of the lens 100 and in the direction of the bottom 201 of the box. The space of the lens 100 above the arms 301*a* and 301*b* is thus reduced and the lens 100 is then immobilized radially and against the rim segments 304. When the internal height H of the box 200 is sufficient relative to the thickness of the lens 100, the convex face S1 of the lens is held by the fingers 305 at a distance from the inner face of the lid 202, automatically when the lid 202 is closed. The lens 100 is thus immobilized inside the closed box 200, even when the latter is turned over or shaken during transport.

If, because of the pincer effect of the arms 301*a* and 301*b*, the bases of the fingers 305 already press on the edge B of the lens 100 when the box 200 is still open (FIG. 4*b*), then the bending of the fingers 305 by the lid 202 when the box 200 is closed increases the pressure of the bases of the fingers on the edge B.

If necessary, the support 300 may also comprise at least one side bearing portion 306 which may be placed on a side of said support that is substantially opposite to one of the fingers 305. The portion 306 is adapted so that, when the closed box contains the support 300 with the lens 100, the edge B of the lens is immobilized laterally between the bearing portion 306 and this finger 305 bent by the lid 202. In this case, the lens 100 is immobilized, relative to lateral movements, between one of the fingers 305 and the side bearing portion 306 which is situated opposite the latter.

To improve the immobilization of a lens which has a small thickness at its peripheral edge B, each finger 305 may comprise a recess 305*b* on a side of this finger which is opposite to the lid, at the base of the finger on the corresponding arm 301*a*, 301*b*. This recess 305*b* may if necessary be extended over the arm 301*a*, 301*b* which supports the finger. It has an abutment surface which is oriented toward the bottom 201 of the box and is adapted to receive an angle of the lens 100 which is situated between the peripheral edge B and the face of said lens which is turned toward the closed lid 202 (FIG. 5*b*). In this manner, when the closed box 200 contains the support 300 with the lens 100, the lens is kept in a more effective manner at a distance from the lid 202 by the recesses 305*b*.

According to yet another improvement of the invention, the support 300 may also comprise one or more other flexible portions 307 which extend in the direction of the lid 202 when the closed box 200 contains the support 300. Each of these other flexible portions 307, which may also have the shape of an additional finger, has a length which is adapted so that the closed lid 202 presses on said portion in order to hold at least one side of the support 300 against the bottom 201 inside the closed box 200. Each finger 307 therefore contributes, like the fingers 305, to preventing any movement of the support 300 in a direction perpendicular to the bottom 201 and to the lid 202. In contrast, relative to the fingers 307, the fingers 305 have the additional function of immobilizing the lens 100 by pressing on the peripheral edge B of the latter.

According to yet another improvement of the packaging, the support 300 may also comprise rigid spacer portions 308. These portions 308 have a height suitable for maintaining, when the closed box 200 contains the support 300, a spacing distance between the bottom 201 and the lid 202 which is at least equal to the internal height H of the box 200. This spacer function of the portions 308 is independent from the fingers 305 and optionally 307. For this purpose, the portions 308 may have a height equal to the distance H, so as to be in contact simultaneously with the bottom 201 and the closed lid 202. The portions 308 help to prevent the closed box 200 being squashed when it is compressed by its bottom and its lid.

Preferably, the internal height H of the closed box 200 is adapted so that the face of the lens 100 that is turned toward the lid 202 is separated from the latter by a distance that is more than 2 mm, in a central portion of this face, when the closed box contains the support 300 with the lens 100. Therefore, even if the closed lid 202 is slightly depressed by an external pressure force, with a movement of less than 2 mm, the lid 202 does not come into contact with the upper face of the lens 100. In this manner, damage to the face S1 of the lens is still prevented, even when the lid 202 is slightly depressed.

If necessary, to limit such depressions of the lid 202 when the latter comprises a portion of shaped sheet of material, the lid 202 may have shape patterns 209 which are suitable or increasing its stiffness.

An additional precaution, to prevent depressions of the closed lid 202 from causing damage to the face S1 of the lens 100, consists in providing a recess 210 in the lid 202. Such a recess 210 is situated inside the closed box facing a central portion of the lens 100. In this manner, the distance between the lens 100 and the lid 202 is increased locally by the height of the recess 210. This height of recess 210 may be equal to 2.5 mm for example.

It is understood that many modifications may be made to the packaging that has just been described in detail while retaining at least some of the advantages of the invention. In particular, it is noted that the rim segments 304 are not essential to the application of the invention. In the absence of such rim segments, the fingers 305 press the lens 100 directly on the bottom 201 of the box 200. Similarly, the additional fingers 307 and the spacer portions 308, in particular, are not compulsory. Finally, the number of fingers 305, which simultaneously hold the lens 100 in the support 300 and this support against the bottom 201 of the closed box, may be varied as soon as at least one such finger is provided on the support 300.

Finally the box 200 may bear an inscription to identify the lens 100 that is contained in said box. Such an inscription may, for example, be a bar code for easy optical reading.

The invention claimed is:

1. A packaging suitable for containing an ophthalmic lens having a predetermined peripheral edge, said packaging comprising:

a box having a bottom, a lid for opening and closing that is substantially parallel to said bottom when the box is closed, and at least one sidewall element defining an internal height of the box comprised between the bottom and the lid; and a support suitable for supporting the lens by the peripheral edge of said lens, dimensions of the box and of the support being suitable for the box to be able to contain the support with the lens in a fixed position when the lid is closed, a convex face of said lens being turned toward the lid in said fixed position, and a height of the support contained in the closed box being equal to the internal height of the box, the packaging being characterized in that the support comprises at least one flexible portion situated close to the peripheral edge of the lens carried by the support, the flexible portion extending in direction of the lid when the closed box contains the support with the lens, with a length of the flexible portion suitable for the closed lid to bend said flexible portion by pressure into a curved flexible portion, and for the curved flexible portion to press against the peripheral edge of the lens so as to hold said lens at a distance from the lid inside the box, the flexible portion being actuated by the lid in order to wedge the lens in the box when said lid is closed, and the wedging of the lens inside the box being relaxed when the box is opened again, wherein the flexible portion of the support comprises a recess provided on a side of said flexible portion that is opposite to the lid when the closed box contains the support with the lens, said recess having an abutment surface oriented toward the bottom of the box and being adapted to receive an angle of the lens situated between the peripheral edge and a face of said lens turned toward the closed lid, so as to keep the lens at a distance from the lid in an additional manner relative to the curvature of the flexible portion.

2. The packaging as claimed in claim 1, wherein the support comprises at least two flexible portions suitable for each to press against the peripheral edge of the lens, at two locations apart from one another along said edge, each flexible portion being bent by the lid when the closed box contains the support with the lens.

3. The packaging as claimed in claim 1, wherein the support also comprises rigid spacer portions suitable for maintaining, when the closed box contains the support, a distance between the bottom and the lid that is at least equal to the internal height of the box independently of the flexible portion.

4. The packaging as claimed in claim 1, wherein the lid has, inside the closed box, a recess situated facing a central portion of the lens, so as to locally increase a distance between the lens and the lid.

5. The packaging as claimed in claim 1, wherein the support is suitable for laterally holding tightly a portion of the peripheral edge of said lens, and for deforming elastically in order to release the lens.

6. The packaging as claimed in claim 5, wherein the support also comprises two arms suitable for extending on two opposite sides of the peripheral edge of the lens , said support being suitable for releasing the lens by an opening of the two arms.

7. The packaging as claimed in claim 6, wherein the two arms of the support are provided with respective support-actuation portions, suitable for causing said arms to open when an external force is applied between said actuation portions.

8. The packaging as claimed in claim 1, wherein the support also comprises at least one rim segment oriented in the direction of the lid when the closed box contains the support with the lens, said rim segment being suitable for maintaining a fixed distance between said lens and the bottom of the box.

9. The packaging as claimed claim 1, wherein the support also comprises at least one side bearing portion, placed on a side of the support that is substantially opposite to the flexible portion and adapted so that, when the closed box contains the support with the lens, the peripheral edge of the lens is immobilized laterally between said bearing portion and said curved flexible portion.

10. The packaging as claimed in claim 1, wherein the support on the one hand, and the bottom or the lid of the box on the other hand, respectively comprise portions with matching reliefs situated facing one another when the support is in the box, in order to prevent a movement of the support parallel to the bottom and to the lid.

11. The packaging as claimed in claim 1, wherein the support also comprises at least one other flexible portion extending in the direction of the lid when the closed box contains the support, with a length of said other flexible portion adapted so that the closed lid presses on said other flexible portion, in order to hold at least one side of the support against the bottom of the box.

12. The packaging as claimed in claim 1, wherein the lid comprises a portion of a shaped sheet of material, and has shape patterns suitable for increasing a stiffness of said lid.

13. The packaging as claimed in claim 1, wherein the lid is connected to the bottom of the box by a hinge.

14. The packaging as claimed in claim 1, wherein the box also comprises fastening elements respectively connected to the bottom and to the lid and suitable for keeping the box closed.

15. The packaging as claimed in claim 14, wherein two fastening elements respectively connected to the bottom and to the lid of the box are suitable for fitting into one another with immobilization when the box is closed.

16. The packaging as claimed in claim 1, wherein the box also comprises grasping portions respectively connected to the bottom and to the lid, and suitable for allowing an opening of the box by parting of said grasping portions.

17. The packaging as claimed in claim 16, wherein two grasping portions situated facing one another when the box is closed have respective edges that are offset relative to one another.

18. The packaging as claimed in claim 1, wherein the internal height of the closed box is adapted so that the convex face of the lens turned toward the lid is separated from said lid by a distance of more than 2 mm, in a central convex portion of said face, when the closed box contains the support with the lens.

* * * * *